US011508288B2

(12) United States Patent
Chun et al.

(10) Patent No.: US 11,508,288 B2
(45) Date of Patent: Nov. 22, 2022

(54) DISPLAY DEVICE CORRECTING GRAYSCALES OF LOGO AND DRIVING METHOD THEREOF

(71) Applicant: SAMSUNG DISPLAY CO., LTD., Yongin-si (KR)

(72) Inventors: Byung Ki Chun, Yongin-si (KR); Hyeon Min Kim, Yongin-si (KR); Young Wook Yoo, Yongin-si (KR); Jun Gyu Lee, Yongin-si (KR); Hyun Jun Lim, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/197,207

(22) Filed: Mar. 10, 2021

(65) Prior Publication Data

US 2021/0375189 A1 Dec. 2, 2021

(30) Foreign Application Priority Data

May 28, 2020 (KR) ..... 10-2020-0064181

(51) Int. Cl.
*G09G 3/20* (2006.01)

(52) U.S. Cl.
CPC ..... *G09G 3/2092* (2013.01); *G09G 2310/027* (2013.01); *G09G 2320/0257* (2013.01); *G09G 2320/046* (2013.01); *G09G 2320/103* (2013.01)

(58) Field of Classification Search
CPC .. G09G 3/2003; G09G 3/2007; G09G 3/2077; G09G 3/2092; G09G 3/3275–3291; G09G 3/3607; G09G 3/3685–3696; G09G 5/02–026; G09G 5/10; G09G 5/24; G09G 5/36; G09G 5/37–377; G09G 5/397; G09G 2310/027; G09G 2310/04; G09G 2320/02; G09G 2320/0233; G09G 2320/0242; G09G 2320/0257; G09G 2320/0271; G09G 2320/0285–0295; G09G 2320/043;
(Continued)

(56) References Cited

U.S. PATENT DOCUMENTS 8,126,270 B2 2/2012 Iinuma
10,027,411 B2 7/2018 Hong et al.
(Continued)

FOREIGN PATENT DOCUMENTS

KR 101645136 B1 8/2016

*Primary Examiner* — Nathan Danielsen
(74) *Attorney, Agent, or Firm* — Cantor Colburn LLP

(57) ABSTRACT

A display device includes pixels; an image converter which generates a second image by correcting grayscales of a logo among a first image for the pixels; and a data driver which provides data voltages corresponding to the second image to the pixels. The image converter generates first accumulated data by accumulating first map data corresponding to a logo area larger than the logo among the first image during a plurality of frame periods, generates second accumulated data by scaling the first accumulated data every refresh cycle, generates third accumulated data by initializing values smaller than a first threshold value among the second accumulated data to be a background value, and specifies pixels corresponding to the logo based on second map data corresponding to the third accumulated data.

15 Claims, 14 Drawing Sheets

(58) Field of Classification Search
CPC ..... G09G 2320/046; G09G 2320/613; G09G 2320/062; G09G 2320/0653; G09G 2320/0686; G09G 2340/10–14; G09G 2340/16
See application file for complete search history.

(56) References Cited

U.S. PATENT DOCUMENTS

| | | | | |
|---|---|---|---|---|
| 2008/0170024 | A1* | 7/2008 | Song | G09G 3/3648 345/96 |
| 2014/0146071 | A1* | 5/2014 | Kim | G09G 3/3225 345/589 |
| 2016/0225344 | A1* | 8/2016 | Joo | G09G 5/10 |
| 2016/0351115 | A1* | 12/2016 | Bang | G09G 3/3208 |
| 2017/0147895 | A1 | 5/2017 | He | |
| 2020/0074596 | A1* | 3/2020 | Chun | G09G 3/2007 |
| 2020/0372860 | A1* | 11/2020 | Kim | G09G 3/3233 |

* cited by examiner

FIG. 5

| PX2 | | PX1 | PX3 | | | LMR | | | | |
|---|---|---|---|---|---|---|---|---|---|---|
| 1 | 0 | 0 | 0 | 0 | 0 | 0 | 0 | 0 | 0 | 0 |
| 0 | 0 | 1 | 1 | 1 | 0 | 1 | 1 | 1 | 0 | 0 |
| 0 | 1 | 0 | 0 | 0 | 0 | 1 | 0 | 1 | 1 | 0 |
| 0 | 1 | 0 | 0 | 0 | 0 | 1 | 0 | 0 | 1 | 0 |
| 0 | 0 | 1 | 1 | 0 | 0 | 1 | 0 | 0 | 1 | 0 |
| 0 | 0 | 0 | 0 | 1 | 0 | 1 | 0 | 0 | 1 | 0 |
| 0 | 0 | 0 | 0 | 1 | 0 | 1 | 0 | 1 | 1 | 0 |
| 0 | 1 | 1 | 1 | 0 | 0 | 1 | 1 | 1 | 0 | 0 |
| 0 | 0 | 0 | 0 | 0 | 0 | 0 | 0 | 0 | 0 | 0 |

FIG. 6

PX2 PX1 PX3 MRD

| | | | | | | | | | | |
|---|---|---|---|---|---|---|---|---|---|---|
| 3 | 0 | 0 | 3 | 0 | 0 | 0 | 5 | 0 | 0 | 0 |
| 1 | 5 | 63 | 62 | 63 | 5 | 63 | 62 | 61 | 5 | 0 |
| 3 | 63 | 9 | 8 | 4 | 3 | 63 | 2 | 61 | 62 | 0 |
| 0 | 61 | 7 | 2 | 0 | 5 | 63 | 0 | 3 | 63 | 3 |
| 0 | 3 | 63 | 63 | 8 | 9 | 63 | 0 | 5 | 63 | 5 |
| 0 | 0 | 8 | 7 | 63 | 10 | 62 | 0 | 6 | 63 | 2 |
| 0 | 7 | 3 | 5 | 62 | 10 | 61 | 3 | 60 | 62 | 0 |
| 1 | 62 | 63 | 63 | 3 | 0 | 61 | 63 | 61 | 7 | 0 |
| 0 | 0 | 3 | 6 | 0 | 0 | 0 | 3 | 6 | 0 | 0 |

FIG. 7

PX2 PX1 PX3 ACR

| | | | | | | | | | | |
|---|---|---|---|---|---|---|---|---|---|---|
| 4 | 0 | 0 | 3 | 0 | 0 | 0 | 5 | 0 | 0 | 0 |
| 1 | 5 | 63 | 63 | 63 | 5 | 63 | 63 | 62 | 5 | 0 |
| 3 | 63 | 9 | 8 | 4 | 3 | 63 | 2 | 62 | 63 | 0 |
| 0 | 62 | 7 | 2 | 0 | 5 | 63 | 0 | 3 | 63 | 3 |
| 0 | 3 | 63 | 63 | 8 | 9 | 63 | 0 | 5 | 63 | 5 |
| 0 | 0 | 8 | 7 | 63 | 10 | 63 | 0 | 6 | 63 | 2 |
| 0 | 7 | 3 | 5 | 63 | 10 | 62 | 3 | 61 | 63 | 0 |
| 1 | 63 | 63 | 63 | 3 | 0 | 62 | 63 | 62 | 7 | 0 |
| 0 | 0 | 3 | 6 | 0 | 0 | 0 | 3 | 6 | 0 | 0 |

FIG. 12

PX2 PX1 PX3 LMF

| | | | | | | | | | | |
|---|---|---|---|---|---|---|---|---|---|---|
| 0 | 0 | 0 | 0 | 0 | 0 | 0 | 0 | 0 | 0 | 0 |
| 0 | 0 | 1 | 1 | 1 | 0 | 1 | 1 | 1 | 0 | 0 |
| 0 | 1 | 0 | 0 | 0 | 0 | 1 | 0 | 1 | 1 | 0 |
| 0 | 1 | 0 | 0 | 0 | 0 | 1 | 0 | 0 | 1 | 0 |
| 0 | 0 | 1 | 1 | 0 | 0 | 1 | 0 | 0 | 1 | 0 |
| 0 | 0 | 0 | 0 | 1 | 0 | 1 | 0 | 0 | 1 | 0 |
| 0 | 0 | 0 | 0 | 1 | 0 | 1 | 0 | 1 | 1 | 0 |
| 0 | 1 | 1 | 1 | 0 | 0 | 1 | 1 | 1 | 0 | 0 |
| 0 | 0 | 0 | 0 | 0 | 0 | 0 | 0 | 0 | 0 | 0 |

FIG. 13

PX2 PX1 PX3 LMR_C1

| | | | | | | | | | | |
|---|---|---|---|---|---|---|---|---|---|---|
| 1 | -1 | -1 | -1 | -1 | -1 | -1 | -1 | -1 | -1 | -1 |
| -1 | -1 | 1 | 1 | 1 | -1 | 1 | 1 | 1 | -1 | -1 |
| -1 | 1 | -1 | -1 | -1 | -1 | 1 | -1 | 1 | 1 | -1 |
| -1 | 1 | -1 | -1 | -1 | -1 | 1 | -1 | -1 | 1 | -1 |
| -1 | -1 | 1 | 1 | -1 | -1 | 1 | -1 | -1 | 1 | -1 |
| -1 | -1 | -1 | -1 | 1 | -1 | 1 | -1 | -1 | 1 | -1 |
| -1 | -1 | -1 | -1 | 1 | -1 | 1 | -1 | 1 | 1 | -1 |
| -1 | 1 | 1 | 1 | -1 | -1 | 1 | 1 | 1 | -1 | -1 |
| -1 | -1 | -1 | -1 | -1 | -1 | -1 | -1 | -1 | -1 | -1 |

FIG. 14

PX2 PX1 PX3 LMR_C2

| | | | | | | | | | | |
|---|---|---|---|---|---|---|---|---|---|---|
| 2 | -1 | -1 | -1 | -1 | -1 | -1 | -1 | -1 | -1 | -1 |
| -1 | -1 | 2 | 2 | 2 | -1 | 2 | 2 | 2 | -1 | -1 |
| -1 | 2 | -1 | -1 | -1 | -1 | 2 | -1 | 2 | 2 | -1 |
| -1 | 2 | -1 | -1 | -1 | -1 | 2 | -1 | -1 | 2 | -1 |
| -1 | -1 | 2 | 2 | -1 | -1 | 2 | -1 | -1 | 2 | -1 |
| -1 | -1 | -1 | -1 | 2 | -1 | 2 | -1 | -1 | 2 | -1 |
| -1 | -1 | -1 | -1 | 2 | -1 | 2 | -1 | 2 | 2 | -1 |
| -1 | 2 | 2 | 2 | -1 | -1 | 2 | 2 | 2 | -1 | -1 |
| -1 | -1 | -1 | -1 | -1 | -1 | -1 | -1 | -1 | -1 | -1 |

DISPLAY DEVICE CORRECTING GRAYSCALES OF LOGO AND DRIVING METHOD THEREOF

The application claims priority to Korean Patent Application No. 10-2020-0064181, filed May 28, 2020, and all the benefits accruing therefrom under 35 U.S.C. § 119, the content of which in its entirety is herein incorporated by reference.

BACKGROUND

1. Field

Embodiments of the invention relate to a display device and a driving method thereof.

2. Description of the Related Art

With the development of information technology, display devices, which are a connection medium between users and information, have been widely used. Such display devices may include a liquid crystal display device, an organic light emitting display device, a plasma display device, and the like.

A display device may include a plurality of pixels and display an image (frame) through a combination of light emitted from the pixels. When a plurality of different images are continuously displayed, a user may recognize the images as a moving image. In addition, when a plurality of identical images are continuously displayed, the user may recognize the images as a still image.

SUMMARY

In a display device, when a still image is displayed for a long time or when a part of a moving image such as a logo is displayed for a long time with a same luminance, pixel deterioration and afterimages may occur. Accordingly, in a display device, grayscales of the logo may be corrected to prevent the afterimages. However, it may be difficult to accurately specify pixels corresponding to the logo.

Embodiments are directed to a display device and a driving method thereof for effectively preventing afterimages by accurately specifying pixels corresponding to a logo.

An embodiment of a display device according to the invention includes: pixels; an image converter which generates a second image by correcting grayscales of a logo among a first image for the pixels; and a data driver which provides data voltages corresponding to the second image to the pixels. In such an embodiment, the image converter generates first accumulated data by accumulating first map data corresponding to a logo area larger than the logo among the first image during a plurality of frame periods, generates second accumulated data by scaling the first accumulated data every refresh cycle, generates third accumulated data by initializing values smaller than a first threshold value among the second accumulated data to be a background value, and specifies pixels corresponding to the logo based on second map data corresponding to the third accumulated data.

In an embodiment, the image converter may include a logo detector which detects the logo area among the first image, and the logo detector may generate the first map data in which pixels identified as the logo among the logo area are indicated as a first binary level and pixels identified as a background among the logo area are indicated as a second binary level.

In an embodiment, the image converter may further include a memory and a data accumulator which generates the first accumulated data, and the data accumulator may generate the first accumulated data by accumulating the first map data in memory data received from the memory.

In an embodiment, the data accumulator may generate the first accumulated data by adding the first map data to the memory data.

In an embodiment, the data accumulator may generate first compensation map data by applying an increase amount to the first binary level of the first map data and applying a decrease amount to the second binary level, and generate the first accumulated data by adding the first compensation map data to the memory data.

In an embodiment, the increase amount may be greater than the decrease amount.

In an embodiment, the image converter may further include a scaler which generates the second accumulated data by down-scaling the first accumulated data every refresh cycle, and the refresh cycle may correspond to p frame periods, and p may be an integer greater than 1.

In an embodiment, a resolution of unit data corresponding to each pixel among the memory data in the memory may be smaller than p.

In an embodiment, the image converter may further include a cut-off unit which generates the third accumulated data by initializing the values smaller than the first threshold value among the second accumulated data to be the background value, and the background value may be the same as the second binary level.

In an embodiment, the memory may store the third accumulated data as the memory data.

In an embodiment, the image converter may further include a logo determining unit which generates the second map data, and the logo determining unit may generate the second map data by replacing values greater than a second threshold value among the third accumulated data with the first binary level and replacing values less than the second threshold value among the third accumulated data with the second binary level.

In an embodiment, the image converter may further include a grayscale converter which generates the second image by specifying the pixels corresponding to the logo based on the second map data and converting grayscales of specified pixels among the first image, and the grayscale converter may specify pixels corresponding to the first binary level among the second map data as the pixels corresponding to the logo.

In an embodiment, the grayscale converter may generate the second image by reducing grayscales of the pixels corresponding to the logo among the first image.

An embodiment of a driving method of a display device according to the invention includes: generating first accumulated data by accumulating first map data corresponding to a logo area larger than a logo among a first image during a plurality of frame periods; generating second accumulated data by scaling the first accumulated data every refresh cycle; generating third accumulated data by initializing values smaller than a first threshold value among the second accumulated data to be a background value; specifying pixels corresponding to the logo based on second map data corresponding to the third accumulated data; and generating a second image by correcting grayscales of specified pixels corresponding to the logo among the first image.

In an embodiment, the driving method may further include generating the first map data in which pixels identified as the logo among the logo area are indicated as a first binary level and pixels identified as a background among the logo area are indicated as a second binary level.

In an embodiment, the generating the first accumulated data may include generating first compensation map data by applying an increase amount to the first binary level of the first map data and applying a decrease amount to the second binary level, and generating the first accumulated data by adding the first compensation map data to the memory data, where the increase amount may be greater than the decrease amount.

In an embodiment, the refresh cycle may correspond to p frame periods, where p may be an integer greater than 1. In such an embodiment, a resolution of unit data corresponding to each pixel among the memory data may be smaller than p.

In an embodiment, the background value may be the same as the second binary level, and the driving method may further include storing the third accumulated data as the memory data.

In an embodiment, the driving method may further include generating the second map data by replacing values greater than a second threshold value among the third accumulated data with the first binary level and replacing values less than the second threshold value among the third accumulated data with the second binary level.

In an embodiment, the generating the second image may include reducing the grayscales of the specified pixels corresponding to the logo among the first image.

BRIEF DESCRIPTION OF THE DRAWINGS

The above and other features of the invention will become more apparent by describing in further detail embodiments thereof with reference to the accompanying drawings, in which:

FIG. 5 is a diagram showing first map data according to an embodiment of the invention;

FIG. 6 is a diagram showing memory data according to an embodiment of the invention;

FIG. 7 is a diagram showing first accumulated data according to an embodiment of the invention;

FIG. 12 is a diagram showing second map data according to an embodiment of the invention;

FIG. 13 is a diagram showing first compensated map data according to an embodiment of the invention; and FIG. 14 is a diagram showing first compensated map data according to an alternative embodiment of the invention.

DETAILED DESCRIPTION

Figure 1:
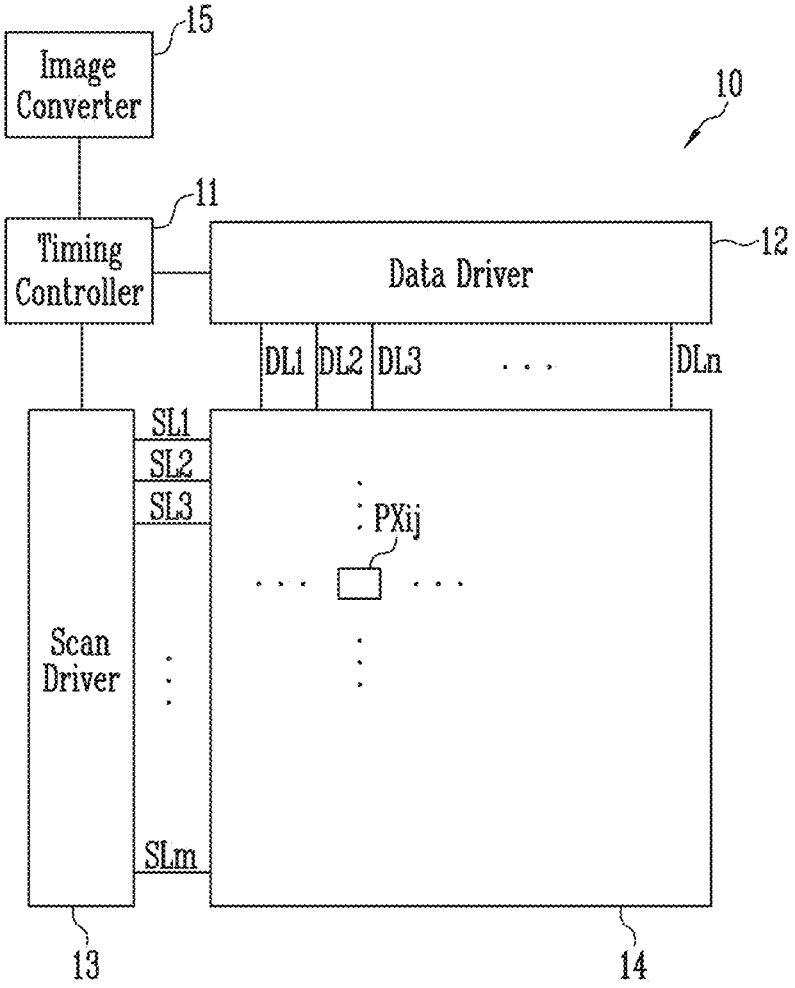
FIG. 1 is a block diagram showing a display device according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in detail with reference to the accompanying drawings.

FIG. 1 is a block diagram showing a display device according to an embodiment of the invention.

Referring to FIG. 1, an embodiment of a display device 10 according to the invention may include a timing controller 11, a data driver 12, a scan driver 13, a pixel unit 14, and an image converter 15.

The timing controller 11 may receive grayscales and control signals for each first image (frame) from an external processor. In one embodiment, for example, when displaying a still image, the grayscales of successive first images may be substantially the same as each other. In one embodiment, for example, when displaying a moving image, the grayscales of successive first images may be substantially different from each other. In such an embodiment, a part of the moving image may be a still area image such as a logo.

The image converter 15 may generate a second image by correcting the grayscales of the logo among the first image. In one embodiment, for example, the image converter 15 may generate first accumulated data by accumulating first map data corresponding to a logo area larger than the logo among the first image during a plurality of frame periods. The image converter 15 may generate second accumulated data by scaling the first accumulated data every refresh cycle. The image converter 15 may generate third accumulated data by initializing values smaller than a first threshold value among the second accumulated data to be a background value. The image converter 15 may specify pixels corresponding to the logo based on second map data corresponding to the third accumulated data. In such an embodiment, the image converter 15 may generate the second image by correcting the grayscales of the specified pixels corresponding to the logo.

In an embodiment, the timing controller 11 may provide grayscales of the second image to the data driver 12. In such an embodiment, the timing controller 11 may provide control signals suitable for each specification to the data driver 12, the scan driver 13, or the like for displaying the second image.

The data driver 12 may provide data voltages corresponding to the second image to the pixels. In one embodiment, for example, the data driver 12 may generate the data voltages to be provided to data lines DL1, DL2, DL3, . . . , and DLn based on the grayscales of the second image and the control signals. In one embodiment, for example, the data driver 12 may sample the grayscales using a clock signal and apply the data voltages corresponding to the grayscales to the data lines DL1 to DLn in units of pixel rows. A pixel row may mean pixels connected to a same scan line, where n may be an integer greater than 0.

The scan driver 13 may receive a clock signal, a scan start signal, or the like from the timing controller 11 and generate scan signals to be provided to scan lines SL1, SL2, SL3, . . . , and SLm, where m may be an integer greater than 0.

The scan driver 13 may sequentially supply the scan signals having a turn-on level pulse to the scan lines SL1 to SLm. The scan driver 13 may include scan stages in a form of a shift register. The scan driver 13 may generate the scan signals by sequentially transmitting the scan start signal in a form of a turn-on level pulse to a next scan stage under a control of the clock signal.

The pixel unit 14 may include the pixels. Each pixel PXij may be connected to a corresponding data line and scan line, where i and j may be integers greater than 0. The pixel PXij may mean a pixel in which a scan transistor is connected to an i-th scan line and a j-th data line.

Figure 2:
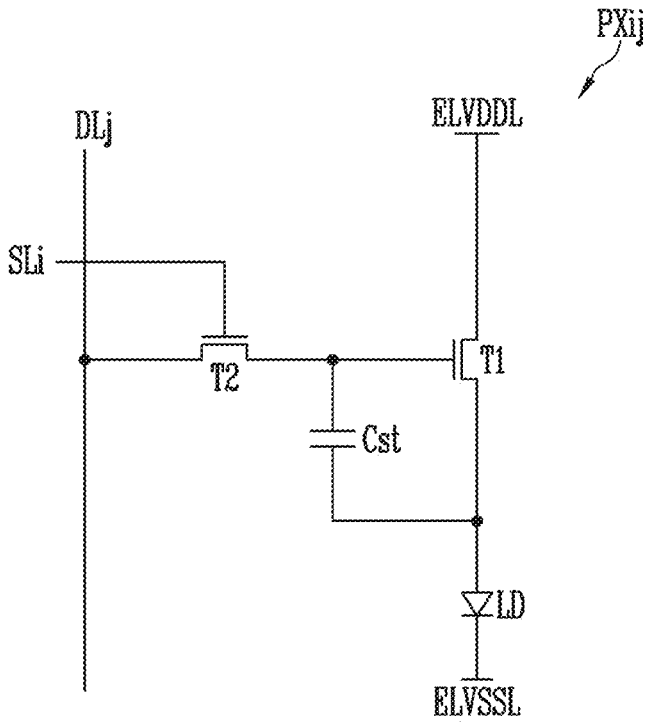
FIG. 2 is a circuit diagram showing a pixel according to an embodiment of the invention.

FIG. 2 is a circuit diagram showing a pixel according to an embodiment of the invention.

Referring to FIG. 2, an embodiment of the pixel PXij may include first and second transistors T1 and T2, a storage capacitor Cst, and a light emitting diode LD.

Hereinafter, for convenience of description, an embodiment where a circuit of the pixel Pxij includes N-type transistors will be described in detail, but not being limited thereto. Alternatively, the circuit of the pixel Pxij may include P-type transistors by varying the polarity of a voltage applied to a gate terminal. Alternatively, the circuit of the pixel Pxij may include a combination of a P-type transistor and an N-type transistor. The P-type transistor generally refers to a transistor in which the amount of current conducted increases when a voltage difference between a gate electrode and a source electrode increases in a negative direction. The N-type transistor generally refers to a transistor in which the amount of current conducted increases when the voltage difference between the gate electrode and the source electrode increases in a positive direction. Each of the transistors may be configured in various forms such as a thin film transistor ("TFT"), field effect transistor ("FET"), or bipolar junction transistor ("BJT").

The first transistor T1 may include a gate electrode connected to a first electrode of the storage capacitor Cst, a first electrode connected to a first power source line ELVDDL, and a second electrode connected to a second electrode of the storage capacitor Cst. The first transistor T1 may be referred to as a driving transistor.

The second transistor T2 may include a gate electrode connected to the i-th scan line SLi, a first electrode connected to the j-th data line DLj, and a second electrode connected to the gate electrode of the first transistor T1. The second transistor T2 may be referred to as a scan transistor.

The first electrode of the storage capacitor Cst may be connected to the gate electrode of the first transistor T1, and the second electrode may be connected to the second electrode of the first transistor T1.

The light emitting diode LD may include an anode connected to the second electrode of the first transistor T1, and a cathode connected to a second power source line ELVSSL. The light emitting diode LD may include or be composed of an organic light emitting diode, an inorganic light emitting diode, a quantum dot/well light emitting diode, or the like. In an embodiment, as shown in FIG. 2 , the pixel PXij may include a single light emitting diode LD, but not being limited thereto. In an alternative embodiment, the pixel PXij may include a plurality of light emitting diodes connected in series, in parallel, or in series and parallel.

A first power source voltage may be applied to the first power source line ELVDDL, and a second power source voltage may be applied to the second power source line ELVSSL. In one embodiment, for example, the first power source voltage may be greater than the second power source voltage.

In an embodiment, when a scan signal of a turn-on level (here, a logic high level) is applied through the scan line SLi, the second transistor T2 may be turned on. When the second transistor T2 is turned on, a data voltage applied to the data line DLj may be stored in the first electrode of the storage capacitor Cst.

A positive driving current corresponding to a voltage difference between the first electrode and the second electrode of the storage capacitor Cst may flow between the first electrode and the second electrode of the first transistor T1. Accordingly, the light emitting diode LD may emit light with a luminance corresponding to the data voltage.

In such an embodiment, when the scan signal of a turn-off level (here, a logic low level) is applied through the scan line SLi, the second transistor T2 may be turned off, and the data line DLj and the first electrode of the storage capacitor Cst may be electrically separated. Therefore, even if the data voltage of the data line DLj is changed, the voltage stored in the first electrode of the storage capacitor Cst may not be changed.

The features described above may be applied not only to the pixel PXij of FIG. 2, but also to pixels including other pixel circuits.

Figure 3:
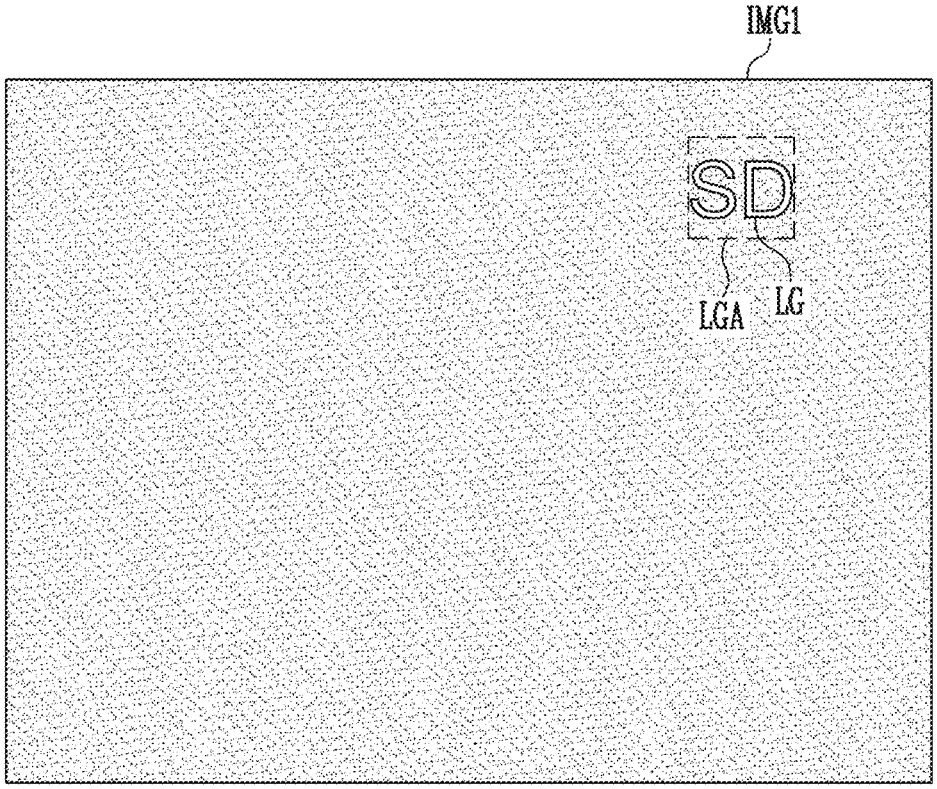
FIG. 3 is a diagram showing a first image, a logo, and a logo area.

FIG. 3 is a diagram showing a first image, a logo, and a logo area.

Referring to FIG. 3, an embodiment of a first image IMG1 displayed on the pixel unit 14 is shown. The first image IMG1 may be data including grayscales for each of the pixels of the pixel unit 14. One first image IMG1 may correspond to one frame image. A period in which one first image IMG1 is displayed may be one frame period. In such an embodiment, a start time point and an end time point of the frame period may be different for each pixel row. In one embodiment, for example, a time point at which scan transistors of a pixel row are turned on to receive the data voltages corresponding to the current first image IMG1 may be the start time point of the frame period of a corresponding pixel row. A time point at which the scan transistors of the pixel row are turned on again to receive the data voltages corresponding to a next first image IMG1 may be the end time point of the frame period of the corresponding pixel row.

A logo LG may be a still image in which the position and grayscale of successive first images IMG1 are maintained. A logo area LGA may include the logo LG and may be an area larger than the logo LG. In one embodiment, for example, the logo area LGA may be a rectangular area. In such an embodiment, where the logo area LGA is the rectangular area such that the logo area LGA may be effectively defined with coordinate values based on the x-axis and y-axis. In an alternative embodiment, the logo area LGA may be defined as another shape such as a circle or an oval. An area other than the logo LG among the logo area LG may be defined as a background.

Figure 4:
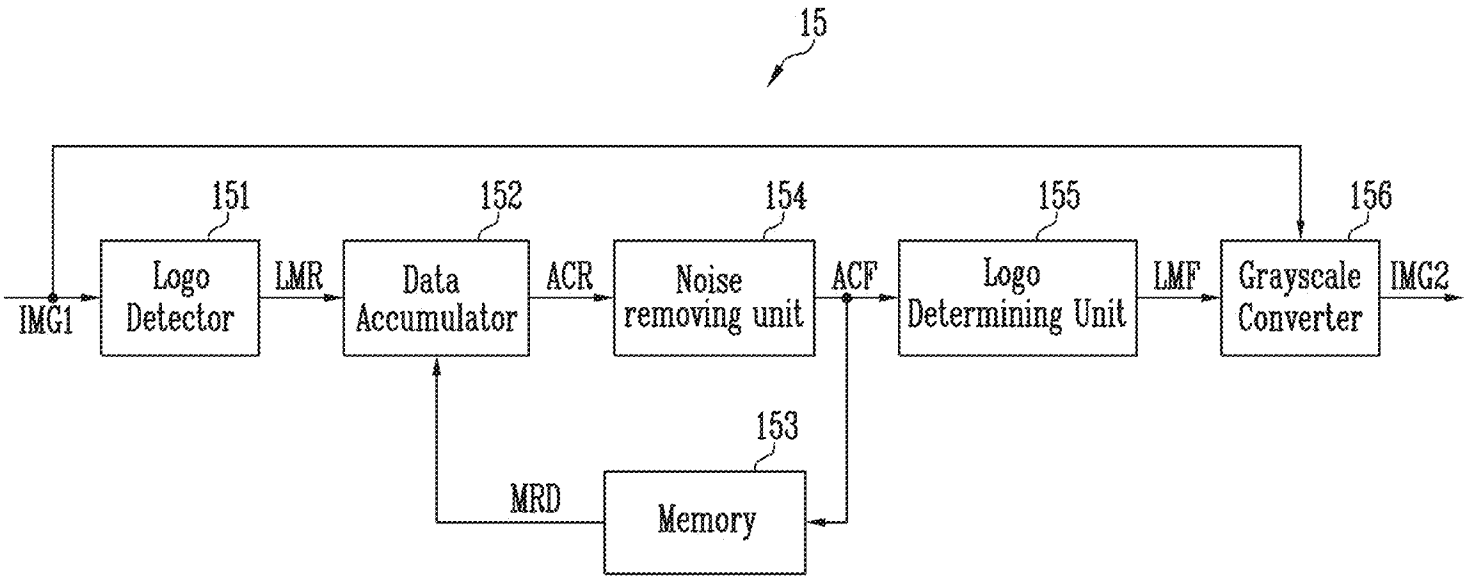
FIG. 4 is a block diagram showing an image converter according to an embodiment of the invention.
Figure 8:
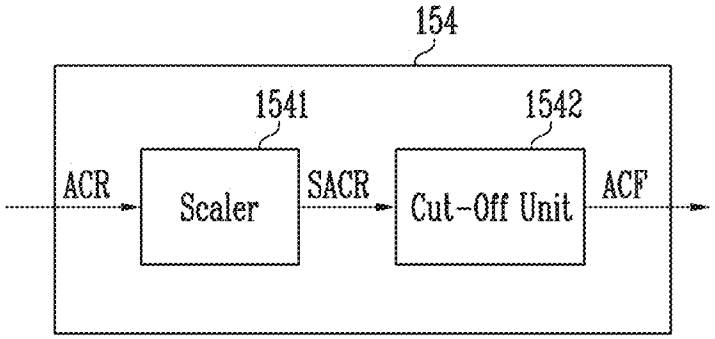
FIG. 8 is a block diagram showing a noise removing unit according to an embodiment of the invention.
Figure 9:
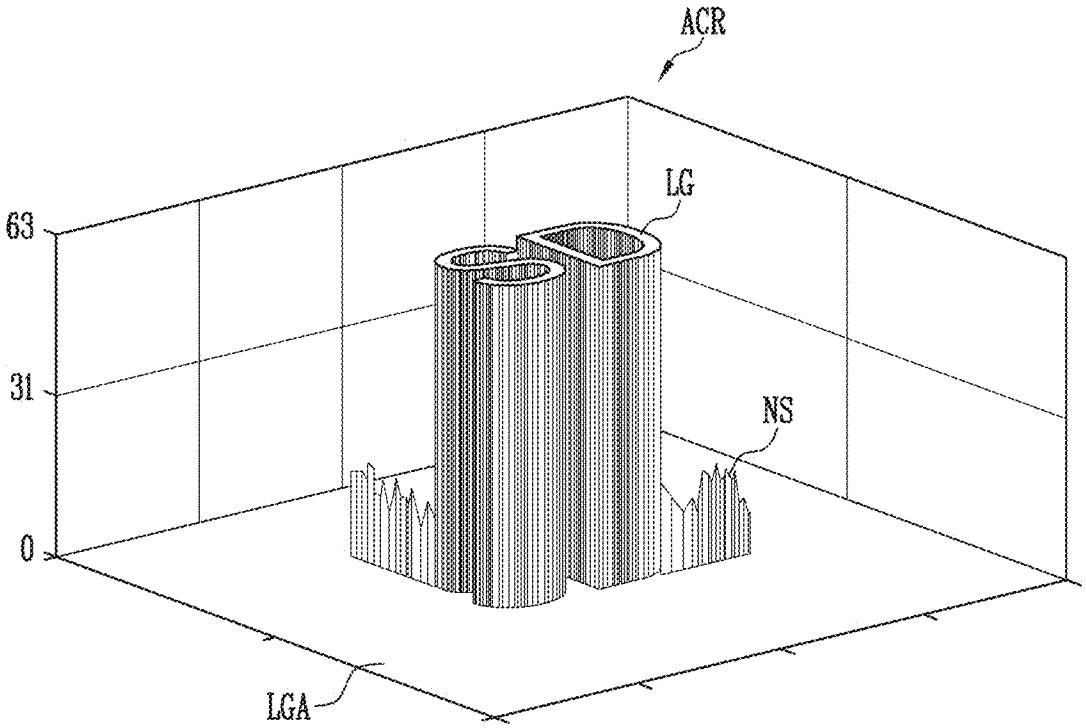
FIG. 9 is a diagram showing first accumulated data according to an embodiment of the invention.
Figure 10:
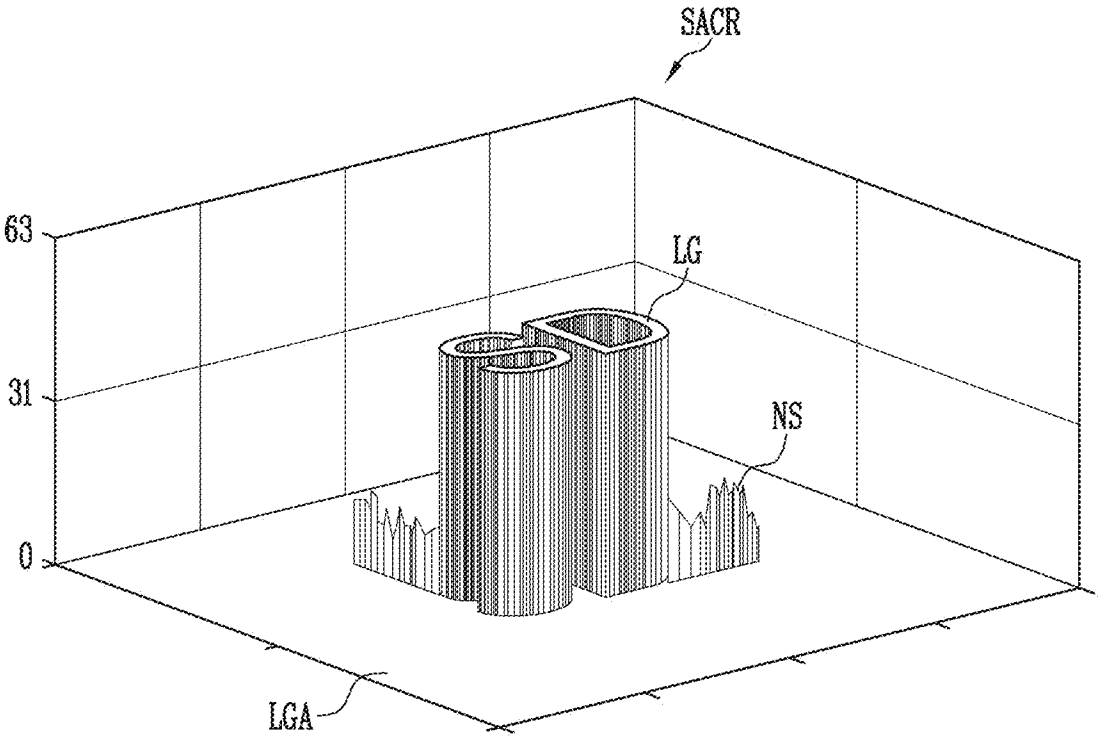
FIG. 10 is a diagram showing second accumulated data according to an embodiment of the invention.
Figure 11:
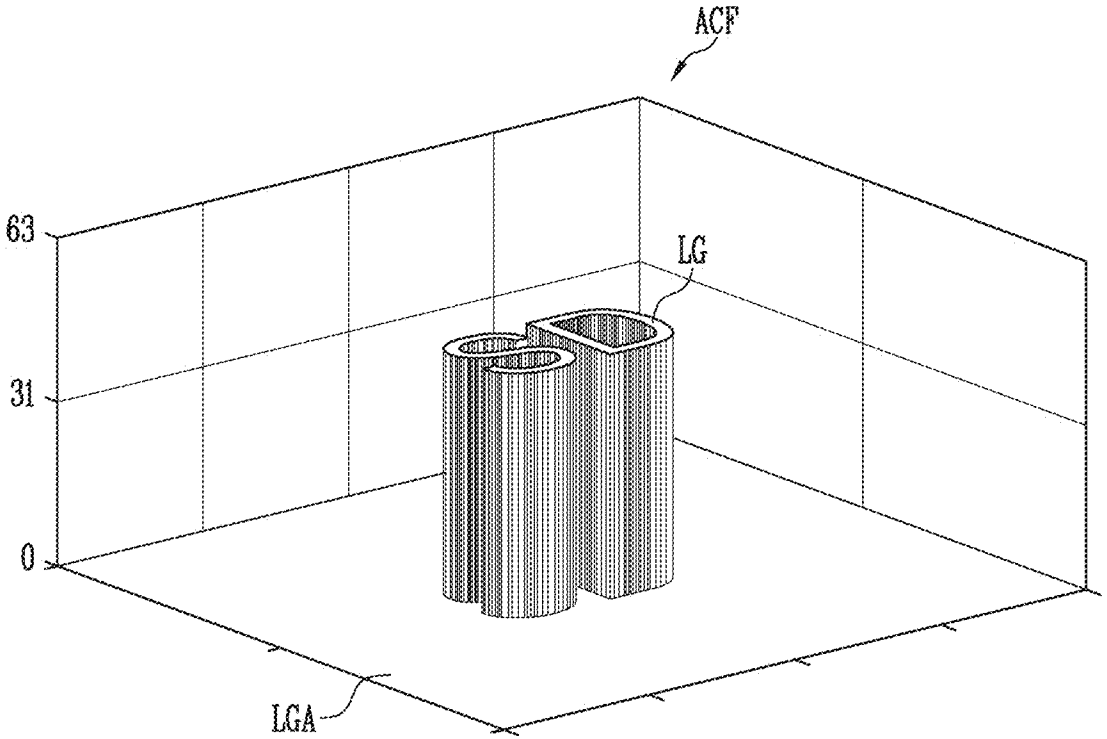
FIG. 11 is a diagram showing third accumulated data according to an embodiment of the invention.

FIG. 4 is a block diagram showing an image converter according to an embodiment of the invention. FIG. 5 is a diagram showing first map data according to an embodiment of the invention. FIG. 6 is a diagram showing memory data according to an embodiment of the invention. FIG. 7 is a diagram showing first accumulated data according to an embodiment of the invention. FIG. 8 is a block diagram showing a noise removing unit according to an embodiment of the invention. FIG. 9 is a diagram showing first accumulated data according to an embodiment of the invention. FIG. 10 is a diagram showing second accumulated data according to an embodiment of the invention. FIG. 11 is a diagram showing third accumulated data according to an embodiment of the invention. FIG. 12 is a diagram showing second map data according to an embodiment of the invention.

Referring to FIG. 4, an embodiment of the image converter 15 according to the invention may include a logo detector 151, a data accumulator 152, a memory 153, a noise removing unit 154, a logo determining unit 155, and a grayscale converter 156. In such an embodiment, the image converter 15 may be in a form of a circuit.

The image converter 15 may generate first accumulated data ACR by accumulating first map data LMR corresponding to the logo area LGA larger than the logo LG among the first image IMG1 during a plurality of frame periods. The image converter 15 may generate second accumulated data SACR (shown in FIG. 8) by scaling the first accumulated data ACR every refresh cycle. The image converter 15 may generate third accumulated data ACF by initializing the values smaller than the first threshold value among the second accumulated data SACR to be the background value. The image converter 15 may specify the pixels corresponding to the logo LG based on second map data LMF corresponding to the third accumulated data ACF. In such an embodiment, the image converter 15 may generate a second image IMG2 by correcting the grayscales of the specified pixels corresponding to the logo LG.

The logo detector 151 may detect the logo area LGA among the first image IMG1. A method for detecting the logo area LGA may be performed using a conventional logo detection algorithm. In one embodiment, for example, a logo detection algorithm using Otsu binarization may be performed.

The logo detector 151 may generate the first map data LMR in which pixels identified as the logo LG among the logo area LGA are indicated as a first binary level and pixels identified as the background among the logo area LGA are indicated as a second binary level. In an embodiment, the first binary level may be set to 1 and the second binary level may be set to 0 in the first map data LRM, as shown in FIG. 5. In one embodiment, for example, in the first map data LMR, values of pixels PX1 and PX3 corresponding to the logo LG may be 1, and values of pixels corresponding to the background may be 0. However, in such an embodiment, the first map data LMR may include an error for the pixel PX2 as shown in FIG. 5 where a value of a pixel PX2 corresponding to the background in the first map data LMR is 1 due to an error or limitation in the logo detection algorithm.

The data accumulator 152 may generate the first accumulated data ACR. The data accumulator 152 may generate the first accumulated data ACR by accumulating the first map data LMR in memory data MRD received from the memory 153. In one embodiment, for example, the data accumulator 152 may generate the first accumulated data ACR by adding the first map data LMR to the memory data MRD.

Referring to FIG. 6, an embodiment of memory data MRD is shown. In one embodiment, for example, the memory 153 may express unit data corresponding to each pixel in 8 bits (0 to 63). In one embodiment, for example, in the memory data MRD, the value of the pixel PX1 may be 63, the value of the pixel PX2 may be 3, and the value of the pixel PX3 may be 62. That is, the values of the pixels PX1 and PX3 corresponding to the logo LG in the memory data MRD may be generally high, and the value of the pixel PX2 corresponding to the background may be substantially low or 0.

Referring to FIG. 7, an embodiment of the first accumulated data ACR obtained by adding the first map data LMR to the memory data MRD is shown. Since the value of the pixel PX1 is already the maximum value of 63, even if a value of 1 of the first map data LMR is added, the value may not be increased and may be maintained at 63. That is, the value of the pixel PX1 may be a saturated state and may not be accumulated nor further increased. Since the value of the pixel PX2 that is not saturated is 4, the value may be increased. Since the value of the pixel PX3 that is not saturated is 63, the value may be increased. In this case, as the first map data LMR is accumulated in the memory 153 for a long time, the possibility that the pixel PX2 corresponding to the background is incorrectly determined as the pixel corresponding to the logo LG may be increased. In an embodiment, the image converter 15 of the invention may include the noise removing unit 154 to effectively prevent the pixel PX2 corresponding to the background from being incorrectly determined to as the pixel corresponding to the logo LG.

Referring to FIG. 8, an embodiment of the noise removing unit 154 may include a scaler 1541 and a cut-off unit 1542.

The scaler 1541 may generate the second accumulated data SACR by down-scaling the first accumulated data ACR every refresh cycle. In one embodiment, for example, the second accumulated data SACR of FIG. 10 may be generated by down-scaling the first accumulated data ACR of FIG. 9 to 75%, such that both data corresponding to the logo LG and data corresponding to the background (or noise NS shown in FIG. 9) may be reduced.

The cut-off unit 1542 may generate the third accumulated data ACF by initializing the values smaller than the first threshold value among the second accumulated data SACR to be the background value. In one embodiment, for example, the background value may be the same as the second binary level (here, 0). Referring to FIG. 11, the third accumulated data ACF may include only values corresponding to the logo LG greater than the first threshold value, and may not include values corresponding to the noise NS less than the first threshold value. The first threshold value may be determined experimentally in advance or through a conventional algorithm.

The memory 153 may store the third accumulated data ACF as the memory data MRD. In such an embodiment, the memory data MRD may be updated with the third accumulated data ACF. Accordingly, the first map data LMR corresponding to the first image IMG1 of the next frame period may be accumulated again in the updated memory data MRD.

According to an embodiment, not only the noise NS is removed from the memory data MRD, but also the value of the pixel PX1 corresponding to the logo LG may be out of the saturated state. Therefore, the first map data LMR may be continuously accumulated in the memory data MRD.

According to an embodiment, the refresh cycle may correspond to p frame periods. In such an embodiment, the memory 153 may be configured such that a resolution of unit data corresponding to each pixel among the memory data MRD is smaller than p. Here, p may be an integer greater than 1. In one embodiment, for example, as shown in FIGS. 5 to 7, p may be 64. According to an experiment, when the refresh cycle corresponds to twice the resolution of the unit data of the memory data MRD (for example, 128 frame periods), the logo LG not including the noise NS may be detected smoothly.

The noise removing unit 154 may operate only in the frame period corresponding to the refresh cycle, and may not operate in the frame period other than the refresh cycle. In one embodiment, for example, the noise removing unit 154 may provide the third accumulated data ACF to the logo determining unit 155 and the memory 153 in the frame period corresponding to the refresh cycle. In such an embodiment, the noise removing unit 154 may provide the first accumulated data ACR to the logo determining unit 155 and the memory 153 in the frame period other than the refresh cycle.

The logo determining unit 155 may generate the second map data LMF. The logo determining unit 155 may generate the second map data LMF by replacing values greater than a second threshold value among the third accumulated data ACF with the first binary level and replacing values less than the second threshold value among the third accumulated data ACF with the second binary level. The second threshold value may be determined experimentally in advance or through a conventional algorithm. Referring to FIG. 12, unlike the first map data LMR, the second map data LMF may have the value of 0 of the pixel PX2, and thus may not include the error of determining the background as the logo LG.

The grayscale converter 156 may specify the pixels corresponding to the logo LG based on the second map data LMF, and convert the grayscales of the specified pixels among the first image IMG1 to generate the second image IMG2. In one embodiment, for example, the grayscale converter 156 may specify pixels corresponding to the first binary level (here, 1) among the second map data LMF as the pixels corresponding to the logo LG.

The grayscale converter 156 may generate the second image IMG2 by reducing the grayscales of the pixels corresponding to the logo LG among the first image IMG1. As a result, the luminance of light emitted from the pixels corresponding to the logo LG among successive frame periods may be reduced and afterimages may be effectively prevented.

FIG. 13 is a diagram showing first compensated map data according to an embodiment of the invention.

According to an embodiment, the data accumulator 152 may generate first compensation map data LMR_C1 by applying an increase amount to the first binary level of the first map data LMR and applying a decrease amount to the second binary level. In such an embodiment, the data accumulator 152 may generate the first accumulated data ACR by adding the first compensation map data LMR_C1 to the memory data MRD.

In such an embodiment, the data accumulator 152 may generate the first accumulated data ACR by adding the first compensation map data LMR_C1 to the memory data MRD rather than adding the first map data LMR directly to the memory data MRD.

In one embodiment, for example, the increase amount and the decrease amount may be the same as each other. In one embodiment, for example, an absolute value of the increase amount and an absolute value of the decrease amount may be the same as each other. In one embodiment, for example, the increase amount may be 1 and the decrease amount may be 1 (i.e., −1). According to an embodiment, the increase in the noise NS over time may be effectively suppressed.

FIG. 14 is a diagram showing first compensated map data according to an alternative embodiment of the invention.

A first compensation map data LMR_C2 of FIG. 14 may be different from the embodiment of FIG. 13 in that the increase amount is greater than the decrease amount. In an embodiment, as shown in FIG. 14, in the first compensation map data LMR_C2, the absolute value of the increase amount may be greater than the absolute value of the decrease amount. In one embodiment, for example, in the first compensation map data LMR_C2, the increase amount may be 2 and the decrease amount may be 1 (i.e., −1).

According to an embodiment, the higher the reliability of the logo detection algorithm of the logo detector 151, the greater the effect. In such an embodiment, the higher the accuracy of the first map data LMR as a result of the logo detection algorithm, the greater the effect. According to the embodiment of FIG. 14, the logo LG may be specified at a faster rate than the embodiment of FIG. 13.

Embodiments of the display device and the driving method thereof according to the invention may effectively prevent the afterimages by accurately specifying the pixels corresponding to the logo.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

pixels;

an image converter which generates a second image by correcting grayscales of a logo among a first image for the pixels; and a data driver which provides data voltages corresponding to the second image to the pixels, wherein the image converter generates first accumulated data by accumulating first map data corresponding to a logo area larger than the logo among the first image during a plurality of frame periods, generates second accumulated data by scaling the first accumulated data every refresh cycle, generates third accumulated data by initializing values smaller than a first threshold value among the second accumulated data to be a background value, and specifies pixels corresponding to the logo based on second map data corresponding to the third accumulated data, wherein the image converter includes a logo detector which detects the logo area among the first image, wherein the logo detector generates the first map data in which pixels identified as the logo among the logo area are indicated as a first binary level and pixels identified as a background among the logo area are indicated as a second binary level, wherein the image converter further includes a memory, and a data accumulator which generates the first accumulated data, wherein the data accumulator generates the first accumulated data by accumulating the first map data in memory data received from the memory, wherein the image converter further includes a scaler which generates the second accumulated data by downscaling the first accumulated data every refresh cycle, wherein the refresh cycle corresponds to p frame periods, and p is an integer greater than 1, and wherein a resolution of unit data corresponding to each pixel among the memory data in the memory is smaller than p.

2. The display device of claim 1, wherein the data accumulator generates the first accumulated data by adding the first map data to the memory data.

3. The display device of claim 1, wherein the data accumulator generates first compensation map data by applying an increase amount to the first binary level of the first map data and applying a decrease amount to the second binary level, and generates the first accumulated data by adding the first compensation map data to the memory data.

4. The display device of claim 3, wherein the increase amount is greater than the decrease amount.

5. The display device of claim 1, wherein the image converter further includes a cut-off unit which generates the third accumulated data by initializing the values smaller than the first threshold value among the second accumulated data to be the background value, and wherein the background value is the same as the second binary level.

6. The display device of claim 5, wherein the memory stores the third accumulated data as the memory data.

7. The display device of claim 6, wherein the image converter further includes a logo determining unit which generates the second map data, wherein the logo determining unit generates the second map data by replacing values greater than a second threshold value among the third accumulated data with the first binary level and replacing values less than the second threshold value among the third accumulated data with the second binary level.

8. The display device of claim 7, wherein the image converter further includes a grayscale converter which generates the second image by specifying the pixels corresponding to the logo based on the second map data and converting grayscales of specified pixels among the first image, wherein the grayscale converter specifies pixels corresponding to the first binary level among the second map data as the pixels corresponding to the logo.

9. The display device of claim 8, wherein the grayscale converter generates the second image by reducing grayscales of the pixels corresponding to the logo among the first image.

10. A driving method of a display device, the driving method comprising:

generating first accumulated data by accumulating first map data corresponding to a logo area larger than a logo among a first image during a plurality of frame periods;

generating the first map data in which pixels identified as the logo among the logo area are indicated as a first binary level and pixels identified as a background among the logo area are indicated as a second binary level;

generating second accumulated data by scaling the first accumulated data every refresh cycle;

generating third accumulated data by initializing values smaller than a first threshold value among the second accumulated data to be a background value;

specifying pixels corresponding to the logo based on second map data corresponding to the third accumulated data; and generating a second image by correcting grayscales of specified pixels corresponding to the logo among the first image, wherein the generating the first accumulated data comprises:

generating first compensation map data by applying an increase amount to the first binary level of the first map data and applying a decrease amount to the second binary level, and generating the first accumulated data by adding the first compensation map data to memory data.

11. The driving method of claim 10, wherein the increase amount is greater than the decrease amount.

12. The driving method of claim 11, wherein the refresh cycle corresponds to p frame periods, wherein p is an integer greater than 1, and a resolution of unit data corresponding to each pixel among the memory data is smaller than p.

13. The driving method of claim 12, wherein the background value is the same as the second binary level, and the driving method further comprises storing the third accumulated data as the memory data.

14. The driving method of claim 13, further comprising:

generating the second map data by replacing values greater than a second threshold value among the third accumulated data with the first binary level and replacing values less than the second threshold value among the third accumulated data with the second binary level.

15. The driving method of claim 14, wherein the generating the second image comprises reducing the grayscales of the specified pixels corresponding to the logo among the first image.

* * * * *